US007879271B2

(12) United States Patent
Olry et al.

(10) Patent No.: US 7,879,271 B2
(45) Date of Patent: Feb. 1, 2011

(54) OBTAINING FIBER TEXTURES OF CARBON BY CARBONIZING A CELLULOSE PRECURSOR

(75) Inventors: Pierre Olry, Bordeaux (FR); Christophe Soumailles, Bordeaux (FR); René Pailler, Cestas (FR); Sylvie Loison, Saint Medard en Jalles (FR); Roman Konig, Prinzersdorf (AT); Alain Guette, Le Bouscat (FR)

(73) Assignee: SNECMA Propulsion Solide, Le Haillan (FR)

( * ) Notice: Subject to any disclaimer, the term of this patent is extended or adjusted under 35 U.S.C. 154(b) by 445 days.

(21) Appl. No.: 11/792,451

(22) PCT Filed: Dec. 6, 2005

(86) PCT No.: PCT/EP2005/056524

§ 371 (c)(1),
(2), (4) Date: Apr. 1, 2008

(87) PCT Pub. No.: WO2006/061386

PCT Pub. Date: Jun. 15, 2006

(65) Prior Publication Data

US 2009/0121380 A1 May 14, 2009

(30) Foreign Application Priority Data

Dec. 7, 2004 (FR) ..... 04 292902

(51) Int. Cl.
*D01F 9/14* (2006.01)

(52) U.S. Cl. ..... 264/188; 264/178 R

(58) Field of Classification Search ..... 264/188, 264/178 R

See application file for complete search history.

(56) References Cited

U.S. PATENT DOCUMENTS

| | | | | |
|---|---|---|---|---|
| 2,978,788 | A * | 4/1961 | Keefe, Jr. | 28/285 |
| 3,969,268 | A * | 7/1976 | Fukuda et al. | 502/425 |
| 4,076,932 | A * | 2/1978 | Hammer et al. | 536/30 |
| 4,123,398 | A * | 10/1978 | Unrau et al. | 524/36 |
| 4,169,905 | A * | 10/1979 | Delaval et al. | 427/177 |
| 6,416,896 | B1 * | 7/2002 | Tamaru et al. | 429/27 |

(Continued)

FOREIGN PATENT DOCUMENTS

JP 62 191518 A 2/1988

(Continued)

OTHER PUBLICATIONS

Bacon, Roger.: "Carbon Fibers From Rayon Precursors", Chemistry and Physics of Carbon, Walker Thrower Editions Marcel Dekker, vol. 9.

*Primary Examiner*—Joseph S Del Sole
*Assistant Examiner*—Kimberly A Stewart
(74) *Attorney, Agent, or Firm*—Weingarten, Schurgin, Gagnebin & Lebovici LLP

(57) ABSTRACT

A method of obtaining fiber textures of carbon from a cellulose precursor includes the steps of: spinning cellulose filaments (12) from a viscose solution or a cellulose solution; subjecting the cellulose filaments to washing in water (21); impregnating the washed and non-dried cellulose filaments with an aqueous emulsion (41) of at least one organosilicon additive; drying the impregnated cellulose filaments; and obtaining a fiber texture made up of impregnated and dried cellulose filaments prior to carbonization.

17 Claims, 4 Drawing Sheets

U.S. PATENT DOCUMENTS 6,967,014 B1 11/2005 Olry et al.
2002/0175310 A1* 11/2002 Messner et al. ..... 252/8.61
2002/0182138 A1 12/2002 Olry et al.
2002/0182139 A1 12/2002 Olry et al.
2004/0028827 A1* 2/2004 Herzig et al. ..... 427/387
2006/0009592 A1* 1/2006 Ochs et al. ..... 525/477

FOREIGN PATENT DOCUMENTS

WO WO 01/42543 6/2001

* cited by examiner

OBTAINING FIBER TEXTURES OF CARBON BY CARBONIZING A CELLULOSE PRECURSOR

This application is a §371 national phase filing of PCT/EP2005/056524 filed Dec. 6, 2005, and claims priority to European application No. EP 04 292 902.6 filed Dec. 7, 2004.

BACKGROUND OF THE INVENTION

The invention relates to obtaining fiber textures of carbon by carbonizing a cellulose precursor.

"Fiber textures" is used herein to designate various types of textures such as yarns, unidirectional sheets made of parallely extending filaments or yarns and bidimensional (2D) or tridimensional (3D) fiber sheets or clothes such as obtained by weaving, knitting or braiding.

Because of their low thermal conductivity, cellulose-precursor carbon fibers are used in particular for fabricating ablation materials, typically for internal wall linings for nozzles and/or for combustion chambers of rocket engines. The term "ablation material" is used to mean a material which, in operation, is progressively eroded by being exposed to a stream of gas at high temperature. Other applications for cellulose-precursor carbon fibers exist or could be envisaged.

Until recently, the cellulose precursor used did not enable carbon fibers to be obtained having remarkable mechanical properties. Typically, the carbon fibers obtained had breaking strength in traction of about 600 megapascals (MPa) and a Young's modulus of about 40 gigapascals (GPa). In addition, the cost of such carbon fibers was high, in particular about 10 to 15 times greater than the cost of high-strength carbon fibers obtained with a polyacrylonitrile precursor.

Processes described in US patent applications Nos. US 2002/0182138, US 2002/0182139, and U.S. Pat. No. 6,967,014, the contents of which are incorporated herein by way of reference, have enabled carbon fibers to be obtained from cellulose precursors of relatively low cost, of the kind commonly used in industry, such as the rayons used for reinforcing tires, and have also enabled the mechanical properties of cellulose-precursor carbon fibers to be improved. Typically, a breaking strength in traction of at least 1200 MPa and a Young's modulus of about 40 GPa or considerably more can be obtained.

Those known processes consist in impregnating the precursor fibers prior to carbonization with an organosilicon additive in solution in an organic solvent such as perchloroethylene. The cellulose precursor used is in the form of yarns or woven cloth in which the fibers are coated in oil that is put in place during fabrication of the yarn in order to facilitate the textile operations to which the yarn is subjected, in particular weaving. It is necessary, or at least preferable to eliminate the oil, or sizing, prior to impregnation with the organosilicon additive(s). That is done by washing using organic solvents such as solvents of the tetrachloroethylene type. The solvents used for removing the oil or for dissolving the organosilicon additives raise environmental problems and they are expensive to recycle.

OBJECT AND SUMMARY OF THE INVENTION

An object of the invention is to remedy those drawbacks, and for this purpose the invention provides a method of obtaining fiber textures of carbon from a cellulose precursor, the method being remarkable in that it comprises the steps consisting in:

spinning cellulose filaments from a viscose solution or a cellulose solution;

subjecting the cellulose filaments to washing in water;

impregnating the washed and non-dried cellulose filaments with an aqueous emulsion of at least one organosilicon additive;

drying the impregnated cellulose filaments;

obtaining a fiber texture made up of impregnated and dried cellulose filaments; and carbonizing the fiber texture by running continuously through a carbonizing enclosure.

A major advantage of the present invention is to enable organosilicon additives to be used in an aqueous medium, so that they do not require an organic solvent whose use would raise the difficulties mentioned above. The Applicant has also found that organosilicon additives in an aqueous emulsion can be deposited in much more uniform manner on filaments of washed viscose after spinning and before drying than on dried viscose filaments.

In one embodiment of the invention, at least one yarn or unidirectional fiber sheet is obtained which is made up of impregnated and dried cellulose filaments and the yarn or unidirectional fiber sheet is carbonized under tension. As a result of the carbonization under tension, a very substantial improvement in the mechanical properties can be achieved. In addition, the constraints imposed on carbonizing cloth in order to avoid undesired deformation thereof do not exist when carbonizing yarns or unidirectional fiber sheets, thereby making it possible to use a temperature profile that is more suitable for carbonization.

In another embodiment of the invention, a bidimensional (2D) or tridimensional (3D) fiber texture is obtained which is made up of impregnated and dried cellulose filaments and the texture is carbonized. Carbonization may be achieved under tension.

The aqueous emulsion may contain 5% to 50% by weight of organosilicon additive(s).

After being impregnated by the aqueous emulsion, and before drying, the filaments may be squeezed so as to have a liquid content lying in the range 10% to 50% of the weight of the dry filaments.

Advantageously, after drying, the organosilicon additive content present on the filaments lies in the range about 1.5% to about 15% by weight relative to the total weight of the filaments.

A yarn may be formed by twisting a plurality of impregnated and dried filaments prior to carbonization.

A unidirectional fiber sheet may be formed, prior to carbonization, of a plurality of impregnated and dried filaments disposed substantially parallel to one another, or of a plurality of yarns formed of impregnated and dried filaments and disposed substantially parallel to one another.

A 2D or 3D fiber texture may be obtained, prior to carbonization, by weaving, knitting or braiding yarns formed of impregnated and dried filaments.

Prior to carbonization, a stage of relaxation or stabilization in air can be performed at a temperature below 200° C., preferably lying in the range 160° C. to 190° C.

Advantageously, the carbonization step comprises a stage of slow pyrolysis followed by final carbonization at high temperature.

During the slow pyrolysis stage, the temperature is raised progressively up to a value lying in the range 360° C. to 750° C.

When carbonizing a yarn or a unidirectional fiber sheet, tension may be applied so that variation in its longitudinal dimension after pyrolysis lies in the range −30% to +40%.

When carbonizing a 2D or 3D fiber texture, the tension applied and the temperature profile selected may be such as disclosed in document WO 01/42543, whereby balanced mechanical and thermal properties are kept. It is also possible to apply substantial tension upon the 2D or 3D fiber structure, whereby different properties in the weft and warp direction would be obtained.

The final carbonization stage is performed by heat treatment at a high temperature lying in the range 1000° C. to 2800° C.

When the fiber texture is in the form of a yarn or unidirectional fiber sheet, tension may be applied to the fiber texture during this stage of final carbonization, in such a manner as to obtain elongation in the longitudinal direction of at most 200%. It is thus possible to obtain carbon fibers having breaking strength in traction greater than 1200 MPa, possibly being as high as 2500 MPa, and having a Young's modulus that is greater than 40 GPa, possibly as high as 350 GPa.

When the fiber texture is a 2D or 3D texture, the final carbonization stage may be carried out as disclosed in document WO 01/42543 or may be carried out under substantial tension.

When a final carbonization stage has been carried out at a temperature of at least 2500° C. and with elongation preferably at least equal to 100%, a further subsequent heat treatment may be carried out at a temperature greater than 2500° C. and during a duration of at least 15 min, preferably at least 30 min, to cause carbon whiskers to develop in the carbon fibers of the fiber texture.

BRIEF DESCRIPTION OF THE DRAWINGS

The invention will be better understood on reading the following description given by way of non-limiting indication and with reference to the accompanying drawings, in which.

DETAILED DESCRIPTION OF IMPLEMENTATIONS OF THE INVENTION

Figure 1:
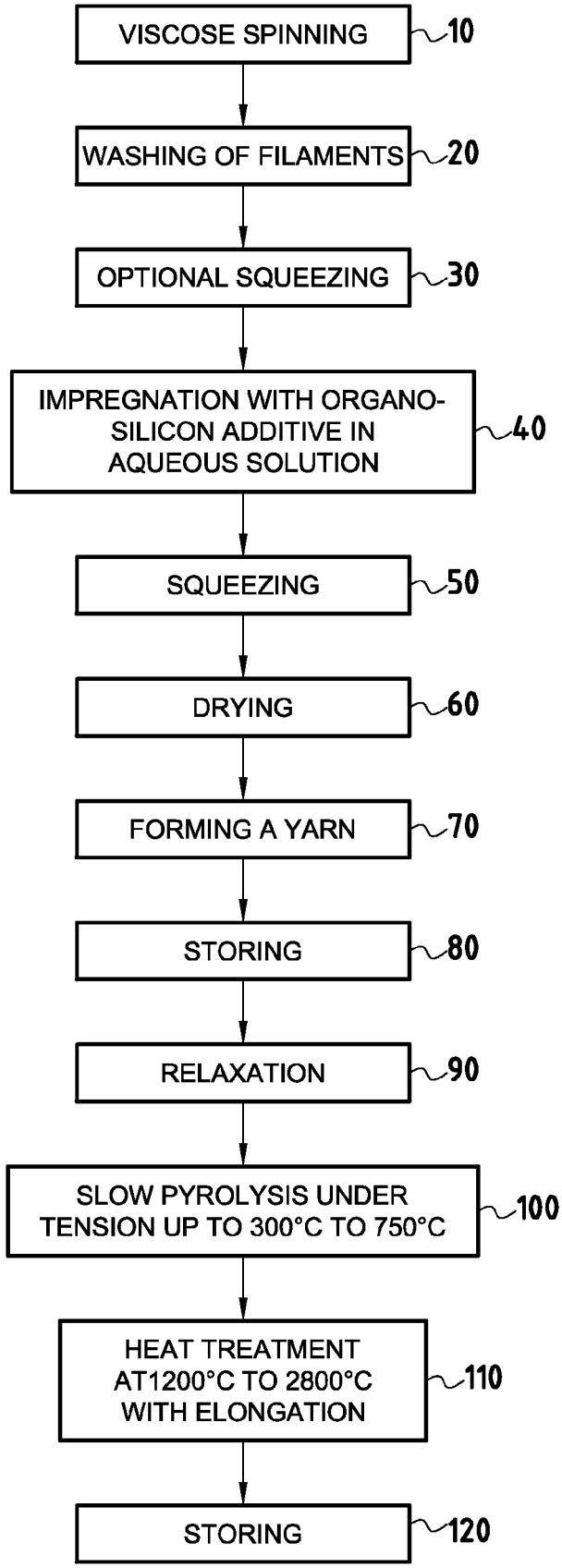
FIG. 1 is a flow chart showing successive steps in one embodiment of a method in accordance with the invention.

A first step 10 of the method of FIG. 1 consists in spinning a plurality of filaments from a solution of viscose or of cellulose. Advantageously, the viscose is of the same type as those that are used for making rayon yarns and that are in widespread use in the textile industry or for reinforcing tires, such as a viscose having an α-cellulose content of at least 95%, and preferably of at least 98%. A cellulose solution may also be used such as a cellulose in a solvent of the n-methyl morpholine oxide type.

Figure 2:
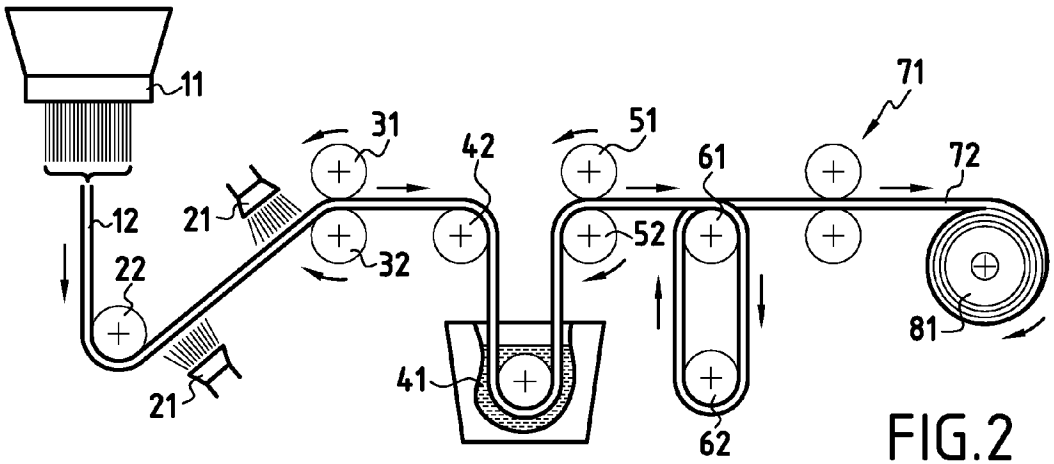
FIG. 2 is highly diagrammatic and shows the preliminary treatment of viscose filaments prior to carbonization.
Figure 3:
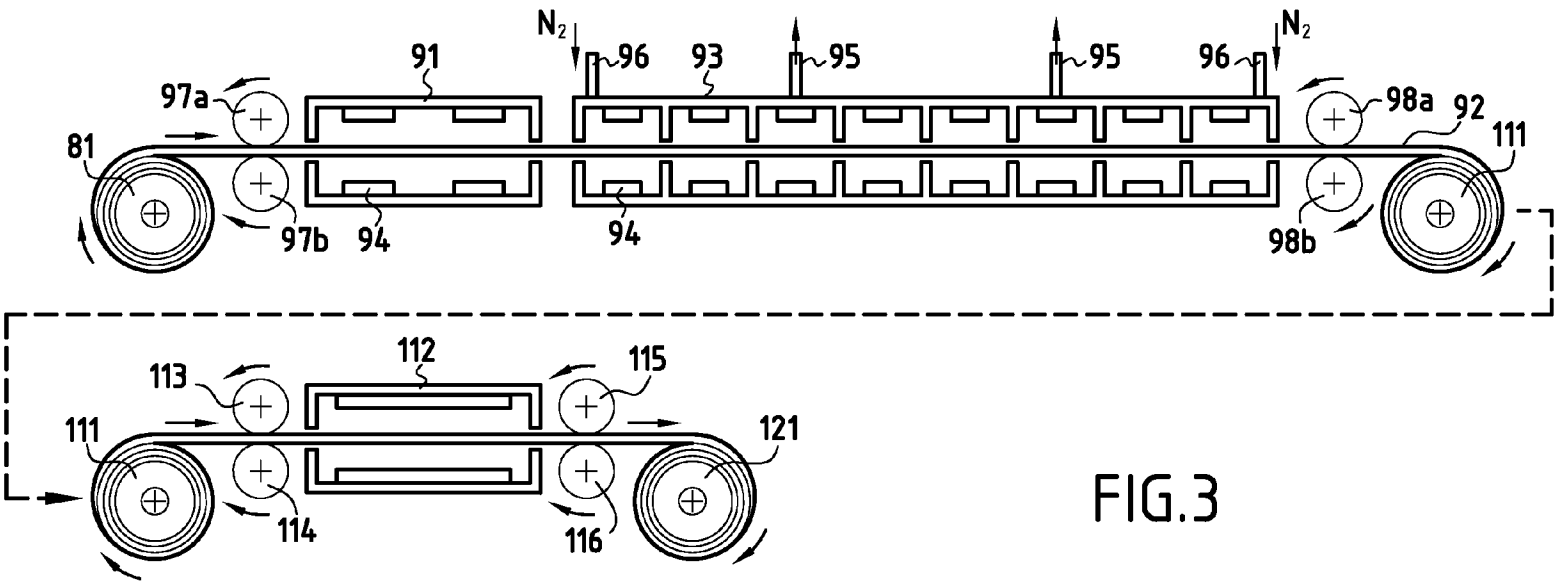
FIG. 3 is highly diagrammatic and shows continuous carbonization of a yarn made up of pre-treated viscose filaments.

Viscose spinning is well known. On leaving the spinneret 11 (FIG. 2), a yarn 12 is obtained that is made up of a plurality of filaments, typically several hundred filaments, e.g. 1000, thereby forming a 1K filament viscose yarn.

The yarn 12 is washed (step 20) by spraying water through nozzles 21 on the path of the yarn between deflector rollers 22 and 42.

Between the rollers 22 and 42, the yarn may optionally be squeezed (step 30) by being passed between rollers 31, 32 in order to reduce its water content prior to subsequently impregnating it with an organosilicon additive in aqueous suspension. If squeezing is performed, it is done in such a manner as to obtain a water content lying in the range 10% to 75% of the dry weight of the yarn.

The washed and non-dried yarn is impregnated with an organosilicon additive in aqueous emulsion by passing through a bath 41 (step 40). Various organosilicon additives that enhance subsequent carbonization of the viscose to obtain a carbon yarn with good mechanical properties are described in the above-cited documents US 2002/0182138 and US 2002/0182139 in the name of the Applicant. Thus, the organosilicon additive may be a polysiloxane selected from the following families:

- polyhydrosiloxanes that are cyclic, linear, or branched, and substituted by methyl and/or phenyl groups, of number average molecular mass in the range 250 to 10,000, and advantageously in the range 2500 to 5000; and
- oligomers and resins that are cross-linked, cyclic, or branched, which present a number molecular mass lying in the range 500 to 10,000 and which are constituted by motifs of formula $SiO_4$ (referred to as $Q_4$ motifs) and motifs of formula $SiO_xR_y(OR')_z$ in which:
  - x, y, and z are integers such that $x+y+z=4$ and $1 \leqq x \leqq 3$, $0 \leqq y \leqq 3$, $0 \leqq z \leqq 3$;
  - R represents hydrogen or an alkyl radical that is linear or branched, having 1 to 10 carbon atoms, it being possible to have different Rs in the same motif when $y \geqq 2$; and
  - R' representing, independently of R, hydrogen or an alkyl radical that is linear or branched, having 1 to 10 carbon atoms, with it being possible to have different R's in the same motif when $z \geqq 2$;

it being understood that:

- for oligomers that present a number average molecular mass of less than 1000, $z \approx 0$ in said formula $SiO_xR_y(OR')_z$; and
- for resins that present a number average molecular mass greater than 2000, $y \approx 0$ in said formula $SiO_xR_y(OR')_z$.

In particular, the organosilicon compound may be a siloxane resin made up of motifs of formula $SiO_4$ (referred to as $Q_4$ motifs), motifs of formula $SiO_3$—OH (referred to $Q_3$ motifs), and motifs of formula O—Si—$R_3$ (referred to as M motifs), advantageously constituted by $n_1$ $Q_4$ motifs, $n_2$ $Q_3$ motifs, and $n_3$ M motifs, with $2 \leqq n_1 \leqq 70$, $3 \leqq n_2 \leqq 50$, and $3 \leqq n_3 \leqq 50$, and presenting a number average molecular mass lying in the range 2500 to 5000.

The organosilicon compound may also be selected from oligomers of a partially hydrolyzed organic silicate, advantageously selected from the oligomers of a partially hydrolyzed alkyl silicate, and preferably selected from the oligomers of partially hydrolyzed ethyl silicates.

Typically, the quantity of organosilicon additive amounts to 5% to 50% of the weight of the aqueous suspension.

It should be observed that inorganic compounds for promoting dehydration of cellulose can also be incorporated in order to increase the carbon yield. Such compounds are Lewis bases or acids, for example acid ammonium phosphate or chloride. Such an objective can also be achieved by proceeding subsequently with relaxation under an atmosphere of hydrochloric acid HCl.

On leaving the bath 41, the impregnated yarn is squeezed (step 50) by passing between squeezing rollers 51, 52. These are arranged to reduce the liquid content to a value lying in the range 10% to 50% of the dry weight of the yarn.

After squeezing, the impregnated yarn is dried (step 60) by passing one or more times over heater rollers 61, 62.

After drying, the organosilicon additive content present on the yarn 12 lies in the range 1.5% to 15% by weight, relative to the total weight of the dry yarn.

The impregnated and dried yarn 12 is then taken to a twisting device 71 to form a twisted yarn 72 (step 70). The yarn 12 can be twisted at a rate of 20 turns per meter (tpm) to 100 tpm. A twisted yarn of greater weight may also be obtained by twisting together a plurality of yarns such as the yarn 12.

The resulting yarn 72 is stored (step 80) by being wound onto a reel 81.

For the purposes of relaxation and pyrolysis (steps 90 and 100), the yarn 72 is taken from the reel 81 and is inserted in succession into a tunnel furnace 91 in air for relaxation and into a pyrolysis tunnel furnace 93 in nitrogen. During the relaxation stage, internal stresses in the filaments are eliminated or at least greatly diminished, resulting in a stabilization of the yarn. The yarn 72 is subjected to slow pyrolysis by raising its temperature in a plurality of stages. It is possible to undertake the following:

a) a first stage of relaxing the yarn in air in the furnace 91 with temperature rising to a value lower than 200° C., preferably lying in the range 160° C. to 190° C., and with the yarn being maintained at this temperature for a duration lying in the range 0.5 hours (h) to 2 h; and b) a second stage of slow pyrolysis comprising, for example:

- a step of raising the temperature up to a value lying in the range 200° C. to 300° C. after penetrating into the furnace 93;
- a step of raising the temperature up to a value lying in the range 240° C. to 350° C.;
- a step at a temperature lying in the range 260° C. to 350° C.;
- a step of raising the temperature up to a value lying in the range 300° C. to 400° C.;
- a step of raising the temperature up to a value lying in the range 330° C. to 450° C.;
- a step of raising the temperature up to a value lying in the range 340° C. to 500° C.;
- a step of raising the temperature up to a value lying in the range 350° C. to 550° C.; and
- a step of raising the temperature up to a value lying in the range 360° C. to 750° C., prior to leaving the furnace 93.

It should be observed that such a temperature profile is not in itself novel. Reference can be made to the document "Carbon fiber rayon precursors" by R. Bacon, Chemistry and Physics of Carbon, Walker Thrower Editions Marcel Dekker, Vol. 9.

The furnace 93 is subdivided into a plurality of zones through which the yarn passes in succession. The temperature in each zone is controlled by powering electrical heater resistance elements (such as 94) as a function of information delivered by temperature sensors (not shown). Sealing boxes may be provided at the inlet and the outlet of the furnace 93. This furnace also presents ducts 95 for exhausting the gaseous by-products of carbonization and ducts 96 for feeding the furnace with an inert sweeping gas such as nitrogen.

The number of zones in the furnace and the temperatures thereof are selected in such a manner as to comply with the pre-established temperature rise profile, it being observed that the number of steps during slow pyrolysis could be other than eight, and in particular it could be less than eight by combining successive steps in order to limit the number of zones in the furnace.

The total transit time through the furnace 93 may lie in the range 30 minutes (min) to 2 h 30 min, for example.

Advantageously, the slow pyrolysis of the yarn 72 is performed under tension. For this purpose, the yarn 72 passes between two drive rollers 97*a*, 97*b* upstream from the inlet to the furnace 91, and the resulting carbon yarn 92 passes between two other drive rollers 98*a*, 98*b* downstream from the outlet of the furnace 93. The speeds of the drive rollers are selected so as to obtain the desired elongation, while avoiding any slip.

During pyrolysis in the free state, the yarn is the subject of dimensional shrinkage which may be as great as 30% to 40% of its initial size. Tension is exerted on the yarn by compensating shrinkage in the longitudinal direction, at least in part, for even compensating shrinkage completely, and possibly causing the yarn to lengthen from its initial state. The variation in the longitudinal dimension of the yarn during slow pyrolysis preferably lies in the range −30% to +40%, with this being obtained by differential control of the downstream rollers 98*a*, 98*b* relative to the upstream rollers 97*a*, 97*b*.

The yarn 92 is subsequently subjected to final carbonization treatment at high temperature (step 110), in continuity with the pyrolysis stage, or possibly after intermediate storage on a reel 111. The treatment is performed in a carbonization furnace 112 at a temperature lying in the range 1200° C. to 2800° C. for a few minutes, and it may be accompanied by the yarn lengthening, where said elongation lies in the range 0% to 200%, for example. This structures the carbon yarn. Above 2500° C., carbon fibers creep, and they do so particularly easily since their carbon presents little organization. The history of the carbon lattice is thus erased and creep leads to almost perfect reorganization of the graphine plane. The high temperature treatment is performed under an inert atmosphere, e.g. under nitrogen.

If it is desired to lengthen the yarn, it is caused to pass between a pair of drive rollers 113, 114 upstream from the inlet to the furnace 112, and a pair of drive rollers 115, 116 downstream from the outlet of the furnace, the upstream and downstream rollers being driven at different speeds of rotation as a function of the desired elongation.

The resulting yarn is stored (step 120) on a reel 121 for subsequent use.

It should be observed that the ability to select optimum conditions for carbonizing the yarn 72, and the fact of implementing carbonization under tension, makes it possible to obtain a carbon yarn having high mechanical properties, namely traction breaking strength lying in the range 1200 MPa to 2500 MPa, and Young's modulus lying in the range 40 GPa to 350 GPa.

Figure 4:
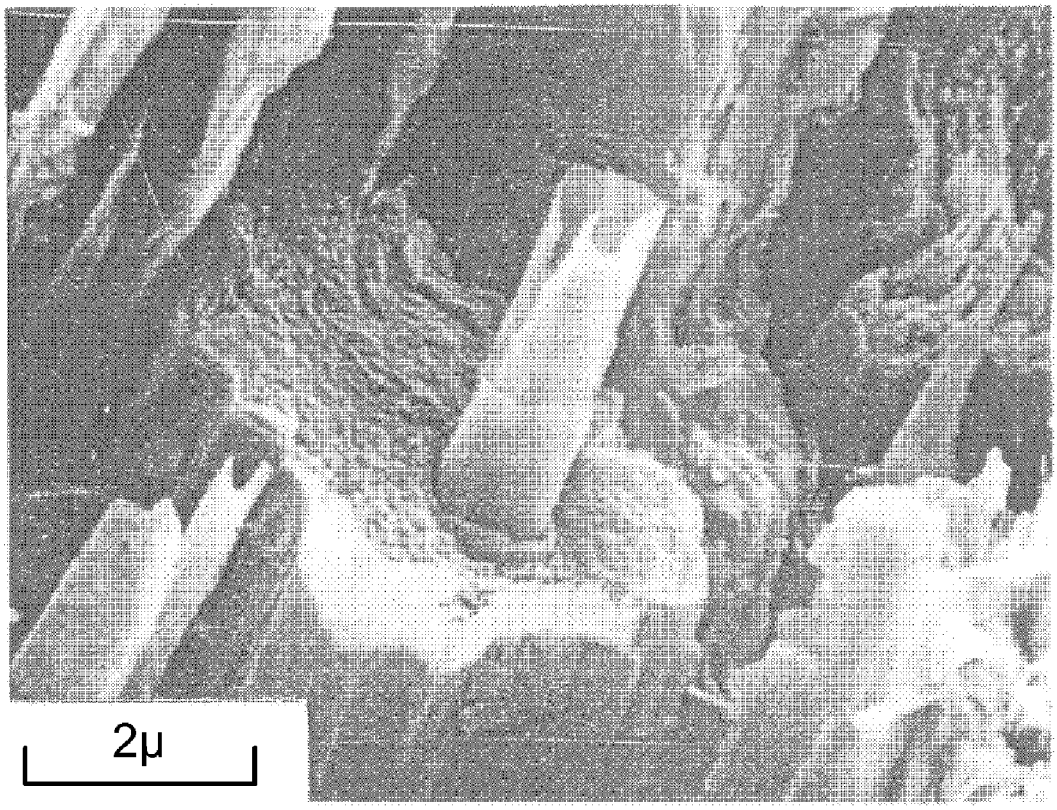
FIG. 4 is a microphotograph showing a carbon fiber obtained from a cellulose precursor and having undergone a high temperature carbonization treatment under elongation followed by a further high temperature treatment.

In addition, the fibers of the yarns that have been subjected to final carbonization treatment at a temperature greater than 2500° C. under elongation preferably at least equal to 100%, not only become graphitizable, but also develop internal carbon whiskers during subsequent heat treatment when carried out at a temperature greater than 2500° C. for a duration ≧15 min, preferably ≧30 min. Such subsequent heat treatment may be performed in batch. FIG. 4 shows such whiskers developed in a carbon fiber of cellulose precursor having been subjected to a heat treatment at 2800° C. during 2 min and under elongation of 200% in a continuous process, followed by a further heat treatment at 2800° C. during about 1 h in a batch process.

Although the description above relates to carbonizing a yarn, the invention is also applicable to forming and carbonizing a unidirectional sheet. Such a sheet may be constituted by filaments or yarns disposed substantially parallel to one another, each yarn itself being made up of a plurality of filaments. Thus, a sheet may be formed of a plurality of yarns 72 for subsequent continuous carbonization.

Example 1

A "Super 2" type rayon yarn was formed by uniting 1000 filaments at the outlet from a spinneret. The yarn was washed in water. The non-squeezed and non-dried yarn was impregnated by passing through a bath of an aqueous emulsion constituted by 60% by weight water and 40% by weight of a mixture of equal parts of emulsions sold under the references Rhodorsil EMUL 55 (based on silicone) and Rhodorsil EMUL 1803 from the supplier Rhodia Silicones. The yarn was squeezed, and then dried by passing over heater rollers at 120° C., prior to being taken to a twisting device in order to obtain a twisted yarn. The organosilicon additive content was about 5% by weight relative to the total weight of the yarn.

The yarn obtained in that way was relaxed by being passed continuously through a furnace in air at 180° C. for 90 min, and was then pyrolyzed by passing continuously through a pyrolysis furnace in a nitrogen atmosphere. The pyrolysis furnace was subdivided into six zones of about same length with temperatures set respectively at 210° C., 250° C., 280° C., 310° C., 340° C., and 370° C. The yarn spent a period of about 1 h in the pyrolysis furnace. During relaxation and carbonization, the yarn was subjected to tension so as to present elongation of 10% at the outlet from the pyrolysis furnace relative to its state prior to entering the furnace with an atmosphere of air, by causing the outlet speed to be 10% above the inlet speed. The yarn was subsequently carbonized at high temperature by passing continuously through a carbonization furnace without being elongated.

The table below gives the values of the traction breaking strength and the Young's modulus as measured on a carbon monofilament for different temperatures of the carbonization furnace.

| Carbonization temperature (° C.) | Traction breaking strength (MPa) | Young's modulus (GPa) | Breaking elongation (%) |
|---|---|---|---|
| 1200 | 1315 | 41 | 3.20 |
| 1500 | 1520 | 45 | 3.38 |
| 1800 | 1720 | 51 | 3.37 |
| 2100 | 1950 | 62 | 3.15 |

Example 2 (for Comparison)

A rayon yarn obtained by uniting 1000 filaments as in Example 1 was dried after washing, and was subjected to textile oiling so as to make the yarn suitable for handling, without being impregnated by an emulsion. After de-oiling, the yarn was thermally relaxed and pyrolyzed by applying the same temperature profile as in Example 1, but without applying tension (pyrolysis with free shrinkage). The pyrolyzed yarn was subsequently carbonized at 1200° C. without elongation.

Measurements on a carbon monofilament gave a traction breaking strength of 580 MPa, a Young's modulus of 38 GPa, and a breaking elongation in traction of 1.5%.

Example 3 (for Comparison)

The procedure was as in Example 2, except that the de-oiled yarn was impregnated prior to thermal relaxation and pyrolysis with an organosilicon additive supplied under the reference RTV 121 by the French supplier Rhodia, in solution in tetrachloroethylene. Impregnation was performed so as to leave a quantity of organosilicon additive on the yarn representing 3% of the weight of the dry yarn.

Measurements were performed on a carbon monofilament giving a breaking strength in traction of 1125 MPa, a Young's modulus of 40 GPa, and a breaking elongation in traction of 2.8%.

The above examples show that a very significant improvement is obtained in the mechanical properties of carbon fibers by implementing the method of the invention, when compared with a method that does not include impregnation with an organosilicon composition (Example 2).

A certain improvement is also observed compared with the method that includes such impregnation performed after drying the rayon yarn (Example 3), as in the state of the art mentioned in the introduction of the description. This improvement is accompanied by the decisive advantage of avoiding recourse to a solvent of the tetrachloroethylene type which raises major problems in terms of the environment and recycling.

Figure 5:
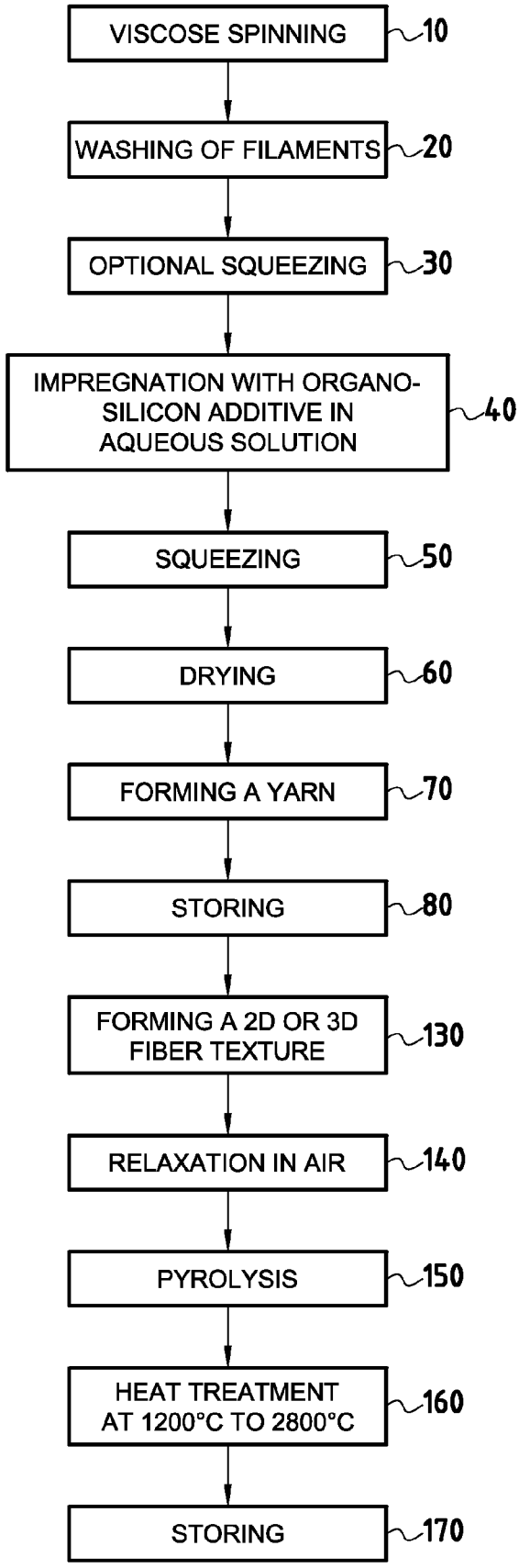
FIG. 5 is a flow chart showing successive steps in another embodiment of a method in accordance with the invention.

In another embodiment of the method according to the invention as shown in FIG. 5, impregnated and dried yarns are obtained and stored by carrying out same steps 10 to 80 as described above with reference to FIG. 1.

Such yarns are used for obtaining a 2D or 3D fiber texture by weaving, knitting or braiding (step 130), such as, for example, a 2D woven cloth.

The fiber texture made of yarns formed of impregnated and dried cellulose filaments is subjected to successive steps of relaxation (step 140) and pyrolysis (step 150).

The relaxation and pyrolysis of the fiber structure can be performed as described above for a yarn, namely a relaxation in air at a temperature lower than 200° C., preferably lying in the range 160° C. to 190° C., and a slow pyrolysis during which the temperature is raised progressively up to a value lying in the range 360° C. to 750° C., without tension in one case or only with moderate tension being applied on the fiber texture to obtain the more equilibrated cloth and on a second case with tension causing the cloth to lengthen from its initial state in the longitudinal direction to obtain a non-equilibrated cloth.

The relaxation and pyrolysis can also be performed on the fiber texture traveling continuously through an enclosure for relaxation under air and a tunnel furnace for pyrolysis under nitrogen, as described in U.S. Pat. No. 6,967,014. Following relaxation, the pyrolysis includes:

- an initial stage for bringing the temperature of the fabric to a value lying in the range 250° C. to 350° C., the initial stage comprising temperature rise at a first mean speed lying in the range 10° C./min to 60° C./min;
- an intermediate stage for raising the temperature of the fabric to a value lying in the range 350° C. to 500° C., the intermediate stage comprising temperature rising at a second mean speed lower than the first and lying in the range 2° C./min to 10° C./min; and
- a final stage for raising the temperature of the fabric to a value lying in the range 500° C. to 750° C., the final stage comprising temperature rising at a third mean speed greater than the second and lying in the range 5° C./min to 40° C./min.

Such a temperature profile is advantageous for the pyrolysis of woven fabric since it makes it possible to minimize the deformation of the fabric resulting from the shrinkage of the cellulose filaments (the more equilibrated cloth is obtained). If it is not the case, the temperature profile and speed can be adapted to get a non equilibrated cloth.

Following pyrolysis, a final carbonization by heat treatment at high temperature can be carried out in a carbonization furnace at a temperature lying in the range 1200° C. to 2800° C. (step 160) similarly to step 110 of FIG. 1, except that the fiber texture may not be subjected to elongation.

The resulting carbon fiber texture is stored (step 170) for subsequent use.

The invention claimed is:

1. A method of obtaining a fiber texture of carbon from a cellulose precursor, the method including the steps of:

spinning cellulose filaments from a viscose solution or a cellulose solution;

subjecting the cellulose filaments to washing in water;

subsequently impregnating the washed and non-dried cellulose filaments with an aqueous emulsion of at least one carbonization-enhancing organosilicon additive;

drying the impregnated cellulose filaments to obtain dried cellulose filaments provided with said carbonization-enhancing organosilicon additive;

making a fiber texture made up of said impregnated and dried cellulose filaments provided with said carbonization-enhancing organosilicon additive, the making of the fiber texture including a step of forming a yarn or unidirectional sheet from a plurality of said impregnated and dried cellulose filaments; and carbonizing the fiber texture.

2. A method according to claim 1, wherein the aqueous emulsion includes 5% to 50% by weight of organosilicon additive(s).

3. A method according to claim 1, wherein, after being impregnated by the aqueous emulsion and prior to drying, the filaments are squeezed so as to obtain a water content lying in the range 10% to 50% by weight of the dry filaments.

4. A method according to claim 1, wherein the organosilicon additive content lies in the range 1.5% to 15% by weight relative to the total weight of the filaments after drying.

5. A method according to claim 1, wherein, after drying and prior to carbonization, a yarn is formed by twisting a plurality of impregnated and dried filaments.

6. A method according to claim 1, wherein, after drying and prior to carbonization, a unidirectional fiber sheet is formed comprising a plurality of impregnated and dried filaments disposed substantially in parallel with one another.

7. A method according to claim 5, wherein, prior to carbonization, a unidirectional sheet is formed comprising a plurality of yarns disposed substantially parallel to one another.

8. A method according to claim 6, wherein the carbonization includes a stage of slow pyrolysis during which the temperature is raised progressively up to a value lying in the range 360° C. to 750° C.

9. A method according to claim 8, wherein, during the slow pyrolysis stage, tension is applied to the yarn or the unidirectional sheet so that the variation in longitudinal dimension after pyrolysis lies in the range −30% to +40%.

10. A method according to claim 5, wherein, prior to carbonization, a bidimensional or tridimensional fiber texture is formed by weaving, knitting or braiding yarns formed from impregnated and dried filaments.

11. A method according to claim 10, wherein the carbonization includes a stage of slow pyrolysis during which the temperature is raised progressively up to a value lying in the range 360° C. to 750° C.

12. A method according to claim 8, wherein, after the slow pyrolysis stage, a stage of final carbonization is performed by heat treatment at high temperature lying in the range 1200° C. to 2800° C.

13. A method according to claim 12, wherein, during the high temperature final carbonization stage, tension is applied to the fiber texture in such a manner as to obtain elongation of not more than 200% in the longitudinal direction.

14. A method according to claim 12, wherein, subsequently to a final carbonization stage at a temperature greater than 2500° C., the fiber texture is subjected to a further heat treatment at a temperature greater than 2500° C. and for a duration of at least 15 minutes to cause development of whiskers within the carbon fibers of the yarn or unidirectional sheet.

15. A method according to claim 8, wherein, prior to slow pyrolysis, a relaxation stage is performed in air at a temperature lower than 200° C.

16. A method according to claim 15, characterized in that the relaxation stage is performed at a temperature lying in the range 160° C. to 190° C.

17. A method according to claim 2, wherein:

after being impregnated by the aqueous emulsion and prior to drying, the filaments are squeezed so as to obtain a water content lying in the range 10% to 50% by weight of the dry filaments;

the organosilicon additive content lies in the range 1.5% to 15% by weight relative to the total weight of the filaments after drying;

after drying and prior to carbonization, either a yarn is formed by twisting a plurality of impregnated and dried filaments, or a unidirectional fiber sheet is formed comprising a plurality of impregnated and dried filaments disposed substantially in parallel with one another;

the carbonization includes a stage of slow pyrolysis during which the temperature is raised progressively up to a value lying in the range 360° C. to 750° C.;

during the slow pyrolysis stage, tension is applied to the yarn or the unidirectional sheet so that the variation in longitudinal dimension after pyrolysis lies in the range −30% to +40%;

after the slow pyrolysis stage, a stage of final carbonization is performed by heat treatment at high temperature lying in the range 1200° C. to 2800° C.

* * * * *